US006094745A

United States Patent [19]

Fulton

[11] Patent Number: 6,094,745

[45] Date of Patent: Aug. 1, 2000

[54] STEALTH WADERS

[75] Inventor: Richard Eustis Fulton, Grand Junction, Colo.

[73] Assignee: Richard E. Fulton, Grand Junction, Colo.

[21] Appl. No.: 09/184,499

[22] Filed: Nov. 2, 1998

Related U.S. Application Data

[60] Provisional application No. 60/065,990, Nov. 14, 1997, and provisional application No. 60/101,219, Sep. 21, 1998.

[51] Int. Cl.[7] ..... A41D 17/00

[52] U.S. Cl. ..... 2/82; 2/242; 36/2 R

[58] Field of Search ..... 2/82, 242, 69, 2/22, 24, 46, 62, 227; 36/2 R, 1.5

[56] References Cited

U.S. PATENT DOCUMENTS

| | | | |
|---|---|---|---|
| 306,077 | 10/1884 | Hawley | 36/2 R |
| 342,152 | 5/1886 | Welton | 36/2 R |
| 1,014,873 | 1/1912 | Hail | 36/2 R |
| 4,856,207 | 8/1989 | Datson | 36/2 R |
| 4,964,176 | 10/1990 | Previdi | 2/242 |
| 5,088,116 | 2/1992 | Gould | 2/82 |
| 5,249,375 | 10/1993 | Tabarly | 36/1.5 |
| 5,613,250 | 3/1997 | Bell | 2/242 |
| 5,642,573 | 7/1997 | Brown | 36/2 R |
| 5,815,948 | 10/1998 | Dzielak | 36/2 R |
| 5,896,676 | 4/1999 | Barousse | 36/2 R |

*Primary Examiner*—Gloria M. Hale

[57] ABSTRACT

This invention relates to an article of clothing or device which is worn on the body, and specifically to a hydrodynamically shaped device which fits over the lower extremity to diminish noise, sound waves, or pressure waves caused by walking within a body of water. The device will also protect the submerged body part from contact or penetration by underwater plants, animals, or objects.

18 Claims, 2 Drawing Sheets

STEALTH WADERS

CROSS REFERENCE TO RELATED APPLICATION

The present invention is a continuation in part of provisional patent application serial No. 60/065,990, filed on and claiming priority of Nov. 14, 1997, and a continuation in part of provisional patent application serial No. 60/101,219 filed on Sep. 21, 1998, the full disclosure of which is incorporated herein by reference.

BACKGROUND

1. Field of Invention

This invention relates to an article of clothing or a device which is worn on the body, and specifically to a hydrodynamically shaped device which fits over the foot and/or leg and diminishes noise, sound waves, or pressure waves caused by walking in water. The device will also protect the submerged body part from contact or penetration by underwater plants, animals, or objects.

2. Description of Prior Art

Sportsmen, hunters, fishermen, and other persons who enjoy or study the outdoors and wildlife are faced with the task of being unobtrusive and undetected by the wildlife of their interest. The keen senses of wildlife creates difficulty in remaining undetected. This task is partially solved by camouflage clothing, blinds which enclose the sportsman, and common sense outdoor techniques of slow, deliberate movement and keeping noise to a minimum. The contact of the shoes with ground objects such as fallen branches, leaves, rocks, and other objects causes airborne noises which reveal the presence of the outdoorsman. U.S. Pat. Nos. 5,168,643 and 4,896,439 describe a sound absorbing shoe and a soundproof cover for shoes respectively which address this problem. In many situations the sportsman is faced with the need to walk through a body of water to approach the wildlife, animals, birds, or fish of interest. The resulting turbulence creates a sound which may frighten the wildlife. There is no known prior art which addresses this aspect. This is the objective of the current invention.

OBJECTIVES AND ADVANTAGES

Accordingly, several objectives and advantages of my invention are to provide a device in which the sound and pressure waves, airborne and underwater sounds, and turbulence associated with wading through water are diminished so that the sportsman, or others, may approach wildlife, fish, or other living things undetected. This is accomplished by providing a hydrodynamically shaped device which may be worn over, or incorporated into, a shoe or boot. The device may also cover at least a portion of the lower leg. In a preferred embodiment, the device may also serve as a gravel guard for the shoe or boot covering the top of the shoe or boot and preventing the ingress of sand, rocks, or gravel into the boot when wading. Other uses include protecting the lower leg and foot, and even more proximally in alternative embodiments, from plants, coral, rocks, sting rays, jellyfish, barracuda, sharks, the rays of the sun, and other perils of the water or sea. Moreover, in fast moving streams the device will allow the fisherman to stand or wade in fast flowing water safely with a lesser threat of losing footing or tiring from the constant pressure of the flowing water.

Fisherman, unless fishing from a boat, must wade to within casting distance to approach fish. The wading creates pressure waves generated as the front part of the leg is propelled through the water. These pressure waves are detected by fish by sensory elements distributed along the lateral aspect of the body of the fish referred to as the lateral line. Most of the airborne sound is created by turbulence as water rushes around the leg and flows into the cavity created by the forward movement of the leg. This is referred to as the cavitation phenomenon and causes pressure waves and sound waves which travel underwater, in addition to the airborne sound detected by the human ear. The cavitation phenomenon is also detected by fish utilizing sensory apparatuses in the lateral line as well as the ear. Sound travels much faster and more efficiently in water than air and is detected by the specialized sensory mechanism of fish much more readily than by humans. The effect of these sound and pressure waves on fish is variable depending on the conditions of the water, i.e., still or flowing, the species of fish, previous fishing intensity, wind, and other factors. In still waters which are fished heavily with no wind to cause wave action, it can be very difficult to approach fish undetected by wading. Barefoot wading in which the foot is removed from the water and then placed slowly into the water with the toes pointed while standing on one leg is effective, but difficult, somewhat dangerous, and nearly impossible for all except the strongest and most experienced guides and fishermen.

Additionally, while wading in streams, ponds, bays, and the ocean, there is a very high likelihood of sand, small rocks, gravel, coral, or other debris to enter the shoe or boot. This causes discomfort and pain and necessitates removal of the shoe or boot so the object can be removed. This is time consuming and awkward to perform, especially if there is nowhere to sit while performing this task.

The present invention solves these and other problems by utilizing a hydrodynamically shaped device which minimizes the pressure and sound waves generated by walking or wading in water. The present invention offers a readily attachable device which will not only serve as a sand or gravel guard, but also allow quiet, undetected wading so that fish can be approached without being frightened.

The present invention may be rendered less visible to fish by underwater camouflage coloring and treatment causing the sportsperson to be even less apparent.

Still further objectives and advantages will become apparent from a consideration of the ensuing description and accompanying drawings.

PREFERRED EMBODIMENT—DESCRIPTION

Figure 1:
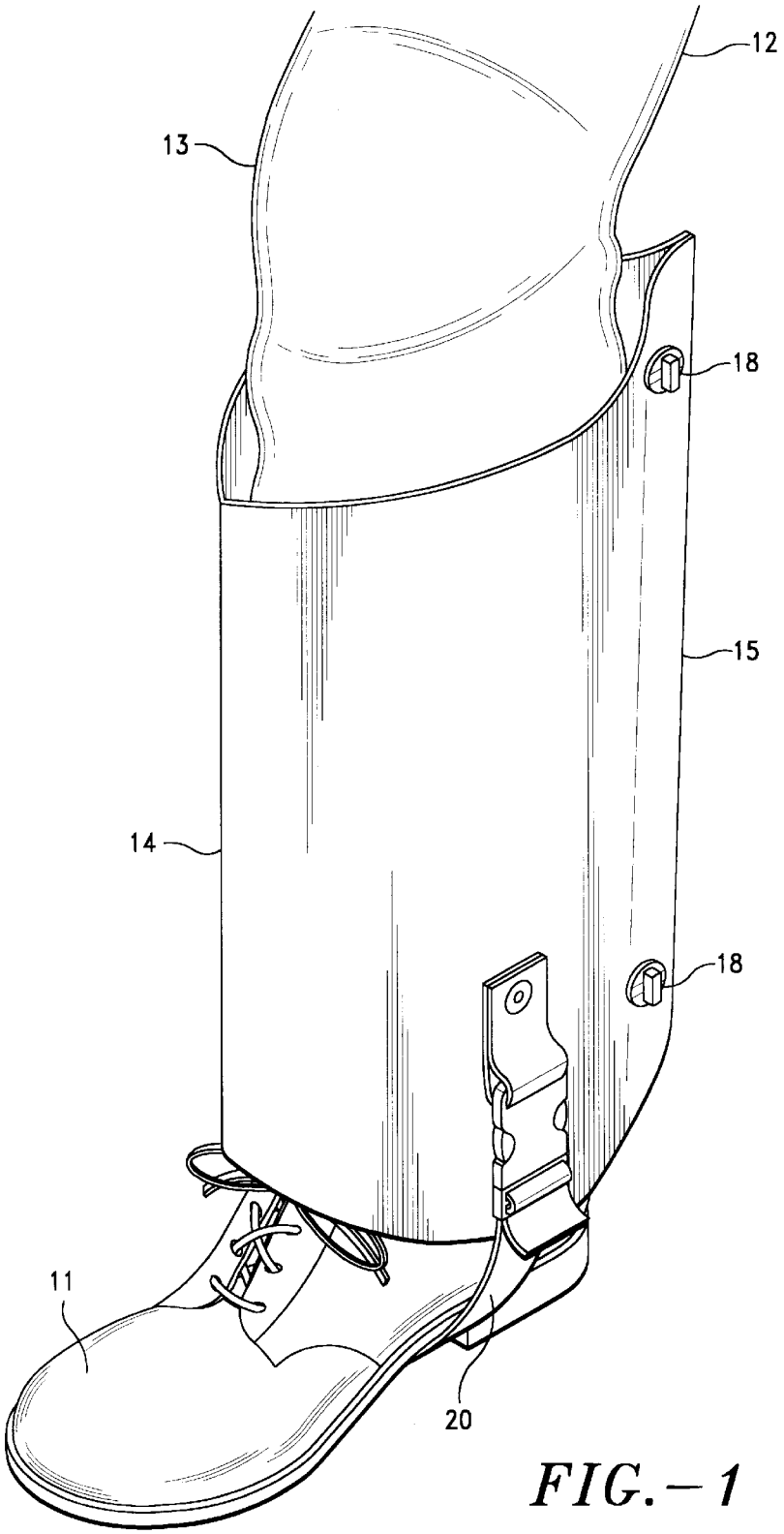
FIG. 1 is a perspective view of my invention.
Figure 2:
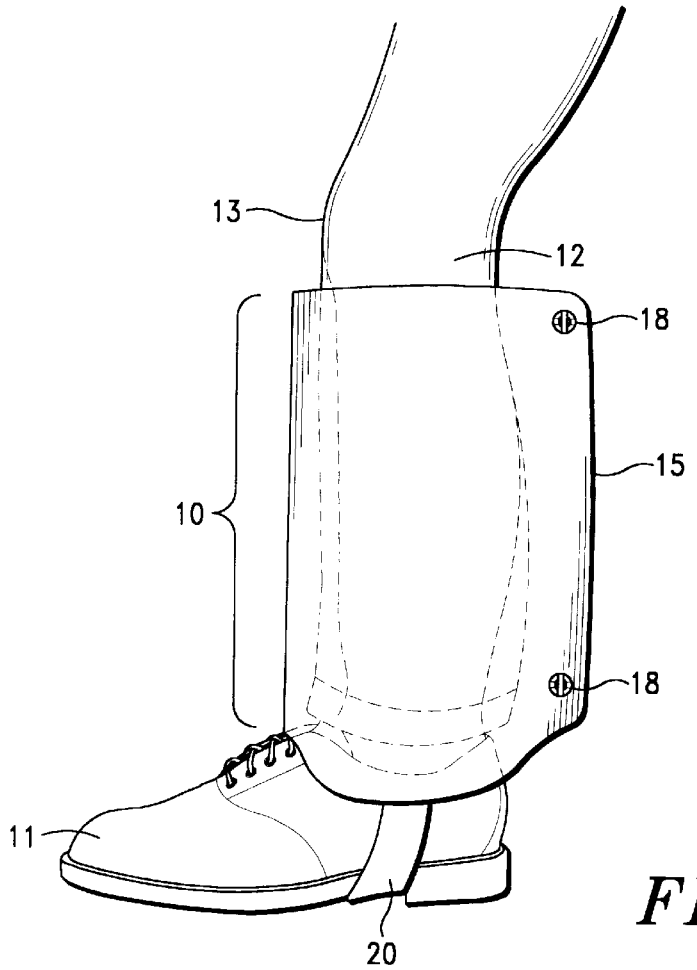
FIG. 2 is a side view of my invention.
Figure 3:
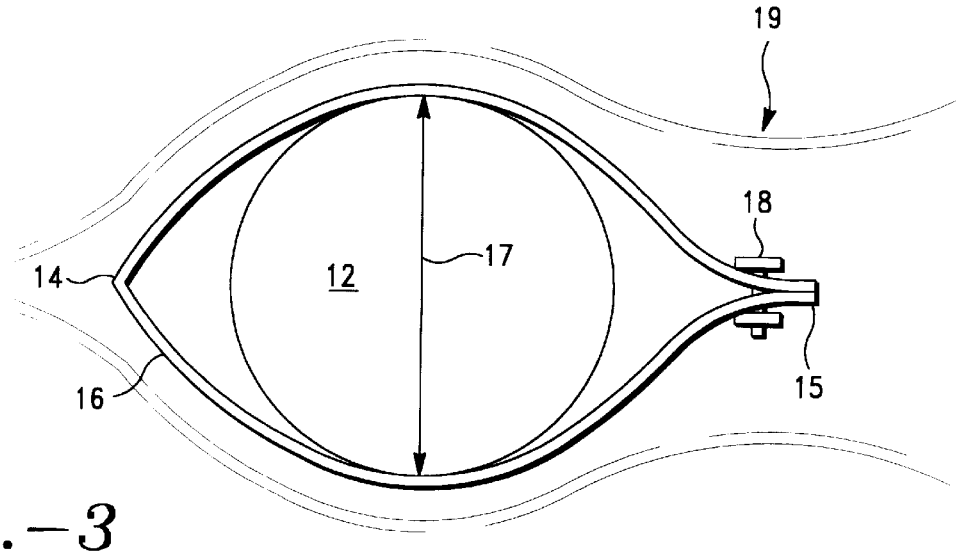
FIG. 3 is a top view of my invention.

A typical embodiment of the present invention is illustrated in FIG. 1 and FIG. 2. The present invention is a device 10 which may be worn over the shoe or boot 11 and lower leg 12 when fishing while standing or wading within a body of water. It may be utilized for many other activities, however. Typically, one device 10 would be used on each lower extremity 12. The device encloses the upper part of the foot and/or the lower leg 12 and extends anterior and posterior to the foot 11 and/or leg 12. It may extend from the foot 11 to the groin but most commonly would extend from the foot 11 to a point just below the knee 13. The preferred embodiment is open in its most proximal extent and the fit around the boot 11 will allow the ingress of water to the inside of the device 10. However, in other embodiments, the proximal or distal ends or both may be sealed to prevent the ingress of water. The device 10 is generally pointed or tapered in its forward or leading edge 14. This will diminish the sound or pressure waves caused by the front part of the leg 12 moving through the water. The rear or trailing edge 15 is also tapered but may be more or less pointed than the forward edge 14. This will diminish the cavitation and noise associated with the turbulence of the water 19. The sides 16 are generally smooth although the surfaces may be roughened slightly. The transverse dimension 17 is great enough to accommodate the leg 12 and it may or may not be a uniform dimension, i.e., tapered about the ankle and foot 11. The sides 16 may be rounded or contain one or more angles which create a space to accommodate the lower leg 12.

In the preferred embodiment, straps 20 secure the lower portion of the device 10 to the foot or boot 11. The rear section 15 of the device is open allowing the leg 12 to be inserted into the device from the rear. Two latches 18 allow closure of the device to secure the leg 12. If the device 10 fits snugly to the boot 11, gravel and other debris may be prevented from entering the boot 11. Otherwise, an elastic member (not shown) may be provided within the device 10 to be placed about the top of the boot 11 to prevent ingress of material.

Placing the foot or boot into the device can be accomplished in several ways. The foot could be inserted into the top of the device, through the device, and exit the bottom of the device similar to putting on a pair of trousers. The device may be constructed so that there is a full or partial opening on the forward, rear, or either side of the device designed for entry. Straps, loops, cords, zippers, VELCRO™ hook and loop fasteners, or other means may be used to securely close the device. Alternatively, if an elastic material is utilized in the construction of the device, it may need no closing or securing mechanism.

The device may be incorporated into a shoe or a boot or may be used separately. When used separately it may have means for securing it to the shoe or boot or means for securing or holding it adjacent to the foot, shoe, or boot. These means would include straps, cords, loops, fasteners, and the like, and these means may extend beneath the shoe or boot.

The device may or may not have a feature to reduce or eliminate the entrance into the boot of sand, rocks, gravel, coral, or other debris. Preferably, this feature would be constructed of a flexible elastic or resilient material and may or may not have a separate closing and/or securing mechanism.

The device may be constructed of a rigid or semirigid material such as plastic, polycarbonate, vinyl, metal, and the like. It may be constructed of a flexible material such as polyester, GORETEX™, plastic, or a combination of any number of different materials. To enhance the ease at which the device travels through water, a lubricious coating may be provided. To even further diminish the sound and pressure waves a soft or other covering may be provided which would tend to dampen the forces caused by propelling the device through fluid. Generally, the two sides of the device are more or less concave toward each other, and this may be accomplished by rounding the sides or utilizing one or more obtuse angles to create the desired hydrodynamic shape. In these discussions, the word "concave" shall describe any combination of angles that would allow the leg to be housed between the tapered forward and rear sections.

PREFERRED EMBODIMENT—OPERATION

The present invention functions very simply. After being attached as previously described, the present invention is worn as an article of clothing. Upon walking within a body of water, the water is diverted around the leg in an efficient and quiet manner. The device may be utilized not only when walking but also to diminish the force and noise which would occur from merely standing within a flowing stream. The device will also protect the covered body part from being penetrated by sharp underwater objects, including fins and stingers.

CONCLUSIONS, RAMIFICATIONS, AND SCOPE

Accordingly, it can be seen that the device of the present invention offers a great advantage to those interested in approaching wildlife and fish in an undetected manner. The current invention will make it easier for a fisherman to simply stand in a fast flowing stream. It also allows a means to protect against the entrance of debris into the shoe or boot.

Although the description above contains many specificities, these should not be construed as limiting the scope of the invention but as merely providing illustrations of some of the presently preferred embodiments of this invention. Various other embodiments and ramifications are possible within its scope. For example, the device may be incorporated into the design of a shoe or boot, or even into a pair of waterproof waders. It may be utilized by the military or security personnel to conduct silent approaches. It may be used by workers or others in which there is a need to walk long distances through water. There may be other uses which demand diminished resistance of water, other liquids, or air.

Thus, the scope of the invention should be determined by the appended claims and their legal equivalents, rather than by the examples given.

What is claimed is:

1. A device to be worn on the body which diminishes the noise, sound waves, or pressure waves caused by walking or standing within a body of water, comprising two sides which are concave toward each other and enclose the body part, a front and rear sections which are tapered sufficiently to glide through the water in a hydrodynamic manner, and a height sufficient to cover at least the upper foot and a portion of the lower leg.

2. The device of claim 1 which is part of, or attached to, a shoe or boot.

3. The device of claim 1 further containing a means to prevent debris from entering the shoe or boot.

4. The device of claim 1 further includes a means of securing the device to the parts of the body submerged in the water.

5. The device of claim 1 which further includes a means of securing the device to the leg or foot.

6. The device of claim 1 which is multicolored, or contains multiple shades of colors intermixed, to resemble light refracted off of multiple layers of flowing water.

7. The device of claim 1 which is covered with a sound absorbing material.

8. The device of claim 1 in which the sides contain one or more obtuse angles separated from the front and rear edges so that the sides create a angular hydrodynamic shape, instead of a curvilinear concave shape, to enclose the body part.

9. A device to be worn on the body which of diminishes the noise, sound waves, pressure waves and other forces caused by flowing water, liquid, or air comprising two sides of semi-rigid material which are concave toward each other to enclose the body part, front and rear sections which are tapered sufficiently to glide through the water in a hydrodynamic manner, and a height sufficient to cover at least the upper foot and a portion of the lower leg.

10. The device of claim 9 which diminishes the forces caused by moving the foot or leg through water.

11. The device of claim 9 which diminishes the forces caused by moving the foot or leg through any fluid.

12. The device of claim 9 which is multicolored, or contains multiple shades of colors intermixed, to resemble light refracted off of multiple layers of flowing water.

13. A device to be worn on the body which protects the foot or leg from fish, plants, coral, or creatures of the sea by preventing contact or penetration of the submerged body part by stingers, teeth, sharp coral, or the like, comprising two sides which are concave toward each other to enclose the body part, a front and rear sections which are tapered sufficiently to glide through the water in a hydrodynamic manner, and a height sufficient to cover at least a portion of the upper foot and lower leg.

14. The device of claim 13 which is comprised of tapered front and rear sections.

15. The device of claim 13 which contains means to permit the entrance of water, but protects the foot, leg, or thigh from other elements of the sea, lakes, rivers, or the like.

16. The device of claim 13 which is multicolored, or contains multiple shades of colors intermixed, to resemble light refracted off of multiple layers of flowing water.

17. The device of claim 13 in which the sides contain one or more obtuse angles separated from the front and rear edges so that the sides create a angular hydrodynamic shape, instead of a curvilinear concave shape, to enclose the body part.

18. A method of walking or standing within still or moving water which diminishes the noise, sound waves, pressure waves, or other pressures using an apparatus comprising two sides which are concave toward each other to enclose the body part, front or rear sections which are tapered sufficiently to glide through the water in a hydrodynamic manner, and a height sufficient to cover at least the upper foot and a portion of the lower leg, comprising attaching the device to the foot or lower leg so that one front tapered end is directed anterior to the leg, walking in moving or standing water slowly enough, or standing in moving water, so that the lower leg and foot glide through the water in a hydrodynamic manner sufficient to diminish forces which cause cavitation, pressure waves and sound waves.

* * * * *